US010145052B2

(12) United States Patent
Kim et al.

(10) Patent No.: US 10,145,052 B2
(45) Date of Patent: Dec. 4, 2018

(54) WASHING MACHINE AND METHOD FOR SUPPLYING WASH WATER OF WASHING MACHINE

(75) Inventors: Kyeonghwan Kim, Seoul (KI); Rayoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 955 days.

(21) Appl. No.: 14/129,391

(22) PCT Filed: Jul. 18, 2012

(86) PCT No.: PCT/KR2012/005727

§ 371 (c)(1),
(2), (4) Date: Dec. 26, 2013

(87) PCT Pub. No.: WO2013/012247

PCT Pub. Date: Jan. 24, 2013

(65) Prior Publication Data

US 2014/0109323 A1 Apr. 24, 2014

(30) Foreign Application Priority Data

Jul. 18, 2011 (KR) ..... 10-2011-0071122
Jul. 19, 2011 (KR) ..... 10-2011-0071677
Jul. 19, 2011 (KR) ..... 10-2011-0071678

(51) Int. Cl.
*D06F 39/08* (2006.01)

(52) U.S. Cl.
CPC ..... *D06F 39/088* (2013.01); *D06F 39/083* (2013.01); *D06F 39/086* (2013.01)

(58) Field of Classification Search
CPC ..... D06F 39/08; D06F 39/086; D06F 39/083; D06F 39/085; D06F 37/04
See application file for complete search history.

(56) References Cited

U.S. PATENT DOCUMENTS 4,987,627 A 1/1991 Cur et al.
7,735,344 B2 * 6/2010 Omura ..... D06F 35/006 68/12.04

(Continued)

FOREIGN PATENT DOCUMENTS

DE 3401899 A1 7/1985
EP 0 519 875 A1 12/1992

(Continued)

OTHER PUBLICATIONS

DE3401899 A1—translation.*

(Continued)

*Primary Examiner* — Rita P Adhlakha
(74) *Attorney, Agent, or Firm* — Ked & Associates, LLP

(57) ABSTRACT

The present disclosure relates to a washing machine comprising: a cabinet; a tub which is accommodated in said cabinet, and accommodates wash water therein; a drum which is installed in said tub to be rotated, an accommodates the laundry; a sump which is equipped on the lower part of said tub such that the wash water is collected; a drain chamber which is connected to the lower part of a drain formed on a bottom surface of said sump, and in which the wash water drained from said drain is temporarily stored; a pump which circulates the wash water drained from said drain chamber; and a drain-side circulation flow path which forms a path in which the wash water circulates between said drain chamber and said pump.

12 Claims, 16 Drawing Sheets

(56) References Cited

U.S. PATENT DOCUMENTS

| | | | | |
|---|---|---|---|---|
| 2005/0132758 | A1 | 6/2005 | Lee et al. | |
| 2009/0249838 | A1* | 10/2009 | Kim | D06F 39/083 68/58 |
| 2009/0249840 | A1 | 10/2009 | Jo et al. | |
| 2010/0018258 | A1* | 1/2010 | Cho | D06F 39/088 68/17 R |
| 2011/0036436 | A1* | 2/2011 | Haltmayer | A47L 15/4217 137/872 |
| 2011/0146002 | A1 | 6/2011 | Kim et al. | |

FOREIGN PATENT DOCUMENTS

| | | | |
|---|---|---|---|
| EP | 2 246 469 | A1 | 11/2010 |
| FR | 2 617 210 | | 6/1988 |
| KR | 10-0195558 | | 6/1999 |
| KR | 10-0436144 | B1 | 6/2004 |
| KR | 10-2004-0092181 | A | 11/2004 |
| KR | 10-2007-0019346 | A | 2/2007 |
| KR | 10-2009-0052607 | A | 5/2009 |
| KR | 10-2009-0107223 | | 10/2009 |
| KR | 10-2010-0066172 | | 6/2010 |

OTHER PUBLICATIONS

International Search Report and Written Opinion dated Jan. 17, 2013 issued in Application No. PCT/KR2012/005727.

European Search Report issued in Application No. 12815558.7 dated Mar. 16, 2015.

Korean Office Action dated Feb. 10, 2017 issued in Application No. 10-2011-0071678.

Korean Office Action dated Mar. 24, 2017 issued in Application No. 10-2011-0071122.

* cited by examiner

WASHING MACHINE AND METHOD FOR SUPPLYING WASH WATER OF WASHING MACHINE

CROSS-REFERENCE TO RELATED PATENT APPLICATIONS

This application is a U.S. National Stage Application under 35 U.S.C. § 371 of PCT Application No. PCT/KR2012/005727, filed Jul. 18, 2012, which claims priority to Korean Patent Application No. 10-2011-071122, filed Jul. 18, 2011; Korean Patent Application No. 10-2011-0071677, filed Jul. 19, 2011; and Korean Patent Application No. 10-2011-0071678, filed Jul. 11, 2011.

TECHNICAL FIELD

The present disclosure relates to a washing machine having a means capable of efficiently increasing the concentration of detergent in wash water, which is sprayed onto clothes and effectively atomizing the sprayed wash water, wash water capable of generating wash water with high concentration, and a supply method for the atomized wash water.

BACKGROUND ART

A washing machine may include a cabinet defining an appearance, a tub accommodated in the cabinet, and a drum rotatably installed in the tub. The washing machine may be classified into a top loading type and a front loading type according to a method of introducing clothes into the drum. The front loading type is generally referred to as a drum-type washing machine.

Hereinafter, description will be given in detail of a drum type washing machine employing the front loading type as one example of the related art washing machine. The front loading type drum washing machine may include an opening and a door formed on a front surface of a cabinet such that the clothes can be introduced and taken out therethrough, and a tub supported by springs and a damper within the cabinet.

The tub may have a cylindrical shape with one side open, and the drum may be rotatably installed in the tub. The tub may accommodate wash water (or washing water) therein. When the drum is rotated, only a lower part of the drum may be sunk in the wash water. Also, the wash water accommodated in the bottom of the tub may be resupplied into the tub or drum for reuse by virtue of a circulation passage (flow path) and a sump disposed in the cabinet.

Meanwhile, the wash water may be sprayed into the drum through a nozzle disposed on a front end of the drum, and then supplied to a target to be washed. Here, the nozzle may be disposed on a gasket. The gasket may be mounted to peripheries of the front openings formed on the tub and the cabinet so as to prevent the wash water within the tub from being leaked into the cabinet.

The nozzle may generally be used to spray wash water into the drum from a top of the gasket. In order to evenly spray the wash water onto the target to be washed, accommodated within the drum, the nozzle may also spray the wash water along a longitudinal direction of the drum.

Wash water containing detergent may flow through a circulation passage (or a circulation flow path) which circulates between the pump disposed below the drum and the drum, and be sprayed to the target to be washed within the drum. Here, only when the detergent is evenly adsorbed and permeates into the target to be washed, the detergent may react with contaminants stuck on the target to be washed so as to improve a washing effect. That is, detergent particles well react with the contaminants stuck on the target to be washed and the washing effect is improved when the concentration of detergent in the wash water is higher or the wash water sprayed is more atomized.

First, the concentration of detergent in the wash water may not be fully increased merely by putting more detergent into the water. This is why the detergent has to be melted in the water. Also, since a time taken by washing has to be considered, it may not be preferable to spend a long time in melting the detergent.

Several technologies have been developed to increase the concentration of detergent and shorten a detergent melting time. For example, only wash water containing detergent is circulated by itself using a pump disposed in a lower portion of a washing machine before the wash water is supplied into the drum. This may allow the detergent to be quickly supplied into the water before supplying the water into the drum.

However, the detergent melting by the self circulating method requires for a large quantity of detergent to be introduced and takes a long time until completely melting the detergent.

On the other hand, the atomization of wash water may be simply achieved if the wash water is sprayed from the nozzle by high spray pressure. The spray pressure of the nozzle may increase in such a manner of reducing a cross section of a spray opening of the nozzle. However, in a general washing machine, wash water circulates along a circulation passage and may contain foreign materials and the like. Also, powder-type detergent, for example, may form a mass without being completely melted. Accordingly, when the spray opening of the nozzle is reduced in cross section in order to atomize the wash water in the general washing machine, the nozzle may be blocked due to the foreign materials or the detergent or fail to spray the wash water smoothly.

For atomizing wash water without increasing spray pressure of a nozzle, a vibrator or the like may be used. However, this method requires for an additional device and a complicated structure, which may result in an increase in fabricating costs.

DISCLOSURE OF THE INVENTION

Therefore, to obviate those problems, an aspect of the detailed description is to provide a washing machine, capable of efficiently increasing the concentration of detergent in wash water.

Another aspect of the detailed description is to provide a washing machine, capable of efficiently increasing the concentration of detergent even when introducing a less quantity of detergent.

Another aspect of the detailed description is to provide a washing machine, capable of completely melting detergent with shortening a detergent melting time.

Another aspect of the detailed description is to provide a washing machine having a means, capable of effectively atomizing wash water.

Another aspect of the detailed description is to provide a method of supplying wash water in a washing machine, capable of obtaining the concentration of detergent in wash water within a fast time by efficiently melting the detergent.

Another aspect of the detailed description is to provide a method of supplying wash water in a washing machine, capable of spraying wash water into the drum by effectively atomizing the wash water.

To achieve these and other advantages and in accordance with the purpose of the present invention, as embodied and broadly described herein, there is provided a washing machine including a cabinet, a tub accommodated in the cabinet and accommodating wash water therein, a drum rotatably installed in the tub and accommodating the laundry, a sump disposed on the lower part of the tub to collect the wash water therein, a drain chamber connected to the lower part of a drain formed on a bottom surface of the sump and temporarily storing the wash water drained out through the drain, a pump to circulate the wash water drained out of the drain chamber, and a drain-side circulation passage forming a path in which the wash water circulates between the drain chamber and the pump.

With the configuration, a circulation passage or flow path may be formed only by wash water containing detergent, so as to generate wash water with high concentration prior to supplying the wash water containing the detergent into the drum.

Meanwhile, the drain-side circulation passage may include a first passage along which the wash water is introduced from the pump into the drain chamber, and a second passage along which the wash water is introduced from the drain chamber into the pump.

The washing machine may further include a spray means disposed in the drain chamber to spray the wash water flowed through the first passage into the drain chamber. The spray means may be a nozzle. The drain chamber may be formed in a hemispherical shape, and the spray means may include a spray opening formed in an inner tangent direction of the drain chamber. Accordingly, the wash water sprayed into the drain chamber may form an eddy current within wash water collected in the sump through the drain.

By reusing remnant detergent which has been left in the tub, the sump and the drain chamber during a previous washing, an amount of detergent to be supplied may be reduced and the concentration of detergent may be efficiently increased. Also, the formation of the eddy current in the wash water may result in more effective use of the remnant detergent and improvement of solubility of the detergent.

The washing machine may further include a detergent storage means to store detergent therein, and a wash water supply passage along which the wash water flowed through the detergent storage means is supplied into the pump. The wash water supply passage may communicate with the second passage.

Here, the washing machine may further include a backflow preventing unit to prevent the wash water supplied through the wash water supply passage from flowing back into the second passage. The backflow preventing unit may be a partition wall which is disposed at a communicating point between the second passage and the wash water supply passage. Or, the backflow preventing unit may be a check valve disposed on the second passage.

The wash water supply passage may allow raw water supplied from an external water supply to be supplied into the pump via the detergent storage means. The wash water supply passage may be configured such that the raw water supplied from the external water supply can selectively contain detergent when flowing through the detergent storage means.

The configuration may be provided to remove remnant detergent in such a manner of supplying the wash water containing the detergent directly into the pump below the tub, without supplying the same through the tub, when the wash water containing the detergent is supplied through the drum or tub, because the detergent frequently remains still on an inner surface of the tub while such wash water flows to the sump along the surface of the tub. This may reduce a loss of detergent supplied in the wash water, and result in reduction of an amount of detergent used.

Also, the raw water may be supplied from the external water supply directly into the pump without containing detergent so as to adjust the concentration of the detergent. This may allow an amount of wash water required for melting the detergent to be efficiently adjusted.

On the other hand, the washing machine may further include a third passage along which the wash water is introduced from the pump into the drum. A drum-side circulation passage may be formed by a wash water flow path from the pump to the drum along the third passage and a wash water flow path from the sump into the pump through the drum.

The third passage may be diverged from the first passage. A three-way valve which selectively decides a wash water supplying direction may be disposed at the diverged point of the third passage.

With the configuration, a path for efficiently supplying wash water with high concentration into the drum can be formed.

The washing machine may further include a first nozzle to spray wash water into the drum, and a second nozzle to spray raw water from an external water supply into the drum. A spray path of the wash water sprayed from the first nozzle and a spray path of the raw water sprayed from the second nozzle may overlap with each other at least one time.

The wash water sprayed from the first nozzle may be atomized due to collision against the raw water sprayed from the second nozzle.

According to the configuration, the wash water can be atomized by the collision against the raw water of high water pressure, supplied from the external water supply, even without reducing a cross section of a spray opening of the nozzle of the wash water, which contains detergent and foreign materials. Consequently, the atomization of the wash water may be allowed even by such simple structure.

The drain-side circulation passage may include a first passage along which the wash water is introduced from the pump into the drain chamber, and a second passage along which the wash water is introduced from the drain chamber into the pump. The washing machine may further include a third passage along which the wash water is introduced from the pump into the tub, and the first nozzle may be formed on the third passage.

With the configuration, wash water with high concentration, generated in the drain-side circulation passage, may be atomized in such a manner of being sprayed into the drum through the first nozzle, and colliding against the raw water sprayed from the second nozzle. Therefore, the atomized wash water particles with the high concentration may be evenly sprayed onto the clothes.

Meanwhile, the first nozzle may spray the wash water along a longitudinal direction of the drum. That is, the wash water sprayed from the first nozzle may be sprayed onto an inner surface and a rear surface of the drum along the longitudinal direction of the drum.

The configuration may be provided to efficiently spray the wash water to the clothes, namely, to spray the wash water in the longitudinal direction of the drum, taking the rotating drum into account. Accordingly, the wash water sprayed from the first nozzle may be sprayed up to the inner surface and the rear surface of the drum, when viewed from the front (an entrance portion) of the drum, thereby being evenly sprayed onto the clothes.

The spray opening of the first nozzle and the spray opening of the second nozzle may be spaced from each other, and the spray opening of the first nozzle may face a spray path of the raw water sprayed from the second nozzle.

At least one of the first nozzle and the second nozzle may be disposed on an upper side of the drum in front of the drum. Here, the first nozzle may be disposed adjacent to the second nozzle. Or, the first nozzle and the second nozzle may be formed integral with each other.

Accordingly, the spray path of the wash water sprayed from the first nozzle may overlap with the spray path of the raw water sprayed from the second nozzle. This may allow for the efficient atomization of the wash water.

The raw water sprayed from the second nozzle may be sprayed into the drum in a conical form. In addition, the raw water sprayed from the second nozzle may be sprayed with forming an eddy current.

Spray pressure of the raw water from the second nozzle may be higher than spray pressure of the wash water from the first nozzle. To this end, the raw water sprayed by the second nozzle may be supplied from the external water supply to the second nozzle through a direct water passage.

By spraying the raw water without containing foreign materials from the external water supply directly into the drum, a cross section of the spray opening can be formed small, which may increase spray pressure of the raw water. Also, the direct supply of the raw water from the external water supply may allow supply water pressure of the external water supply to be used as it is, resulting in efficiently obtaining the high spray pressure of the raw water.

To achieve these and other advantages and in accordance with the purpose of the present invention, as embodied and broadly described herein, there is provided a method of supplying wash water in a washing machine, in which wash water containing detergent is supplied into a drum, the method including a wash water generating step of generating wash water containing detergent in such a manner that raw water supplied from an external water supply flows through a detergent storage means and circulates between a drain chamber connected to a drain formed on the lower part of a sump and a pump, and a wash water supplying step of supplying the generated wash water into the drum.

By reusing remnant detergent which has been left in the tub, the sump and the drain chamber during a previous washing, an amount of detergent to be supplied may be reduced and the concentration of detergent may be efficiently increased.

In the wash water generating step, wash water or raw water may be sprayed into the drain chamber to form an eddy current in wash water collected in the sump, which may result in more effective use of the remnant detergent and improvement of solubility of the detergent.

A circulation passage may be formed only by the wash water containing the detergent. Accordingly, wash water with high concentration may be generated prior to supplying the wash water containing the detergent in the drum.

In the wash water generating step, a heater may be operated to increase temperature of wash water. The increased temperature of the wash water may increase solubility of the detergent, resulting in generation of the wash water with the high concentration.

The wash water generating step may be executed to supply the raw water from the external water supply directly into the pump, thereby adjusting an amount of wash water circulated. Or, in the wash water generating step, the raw water from the external water supply may be supplied in the drum via the drum, so as to adjust the amount of wash water circulated. Since some raw water is required at an appropriate temperature in order to melt the detergent in the wash water, a required amount of wash water may be supplied.

The wash water generating step may be executed to stir the wash water containing the detergent by an impeller of the pump, so as to efficiently increase the solubility of the detergent.

In the wash water generating step, the raw water supplied from the external water supply may be directly supplied into the pump through a separate passage via the detergent storage means, without passing through the tub. The configuration may be provided to remove remnant detergent in such a manner of supplying the wash water directly into the pump below the tub, without supplying the same through the tub, when the wash water is supplied through the drum or tub, because the detergent frequently remains still on an inner surface of the tub while such wash water flows to the sump along the surface of the tub. This may reduce a loss of detergent supplied in the wash water, resulting in reduction of an amount of detergent used.

The wash water supplying step may be executed to supply the wash water into clothes by atomizing the wash water in such a manner that a wash water spray path of a first nozzle for spraying the wash water from the pump into the drum overlaps, at least one time, with a raw water spray path of a second nozzle for spraying the raw water from an external water supply into the drum. Accordingly, detergent with high concentration can efficiently permeate into the clothes.

In the meantime, the method may further include a clothes amount sensing step of measuring an amount of clothes accommodated in the drum prior to the wash water generating step. In this case, in the wash water generating step, the raw water from the external water supply may be supplied directly into the pump so as to adjust the concentration of the detergent in the wash water, or the raw water may be supplied from the external water supply into the pump via the drum, so as to adjust the concentration of the detergent in the wash water.

According to the configuration, the concentration of detergent can be appropriately adjusted based on an amount of clothes introduced in the drum, such that the detergent can permeate into the clothes in an efficient manner.

ADVANTAGEOUS EFFECT

The present disclosure may provide the following effects by the configuration.

By reusing remnant detergent which has been left in the tub, the sump and the drain chamber during a previous washing, an amount of detergent to be supplied may be reduced and the concentration of detergent may be efficiently increased.

The washing machine according to the present disclosure may generate wash water with high concentration prior to supplying wash water containing detergent into the drum in such a manner of forming a circulation passage only by the wash water containing the detergent.

Also, the formation of the eddy current in the wash water may result in more effective use of the remnant detergent and improvement of solubility of the detergent.

The washing machine according to the present disclosure may reduce remnant detergent by directly supplying the wash water to the pump below the tub, without passing through the tub, and also reduce an amount of detergent used in response to reduction of a loss of detergent.

The washing machine according to the present disclosure may allow for efficient adjustment of an amount of wash water which is required to melt detergent, in such a manner as to supply raw water directly into the pump without containing detergent.

The washing machine according to the present disclosure may atomize wash water by way of collision against the raw water with high water pressure, supplied from the external water supply, even without reducing a cross section of a spray opening of a nozzle from which wash water containing detergent and foreign materials is sprayed. Accordingly, the atomization of the wash water can be achieved merely by a simple structure. Especially, it may be more effective for highly enriched wash water which contains detergent with high concentration.

The washing machine according to the present disclosure may allow the wash water to be sprayed into the clothes evenly and stereoscopically, in such a manner that the wash water spray path overlaps with the raw water spray path due to the collision against the raw water with high water pressure.

Also, the washing machine may increase permeability of detergent into the clothes by use of spraying force transferred due to the collision against the raw water with high spraying force. Accordingly, a washing effect can be more improved. Specifically, for the highly enriched wash water which contains detergent with high concentration, the washing effect by the detergent can be much more improved.

According to the wash water supplying method according to the present disclosure, the wash water with the high concentration can be generated and supplied in the drum. The detergent with the high concentration can thusly efficiently permeate into the clothes, resulting in improvement of the washing effect.

According to the wash water supplying method according to the present disclosure, wash water with high concentration may be generated prior to supplying wash water containing detergent into the drum, in such a manner as to form a circulation passage only by the wash water containing the detergent.

According to the wash water supplying method according to the present disclosure, an amount of detergent to be supplied may be reduced and the concentration of detergent may be efficiently increased in such a manner of reusing remnant detergent which has been left in the tub, the sump and the drain chamber during a previous washing.

According to the wash water supplying method according to the present disclosure, the remnant detergent may be more efficiently used and the solubility of the detergent may be increased by forming an eddy current in the wash water.

According to the wash water supplying method according to the present disclosure, temperature of the wash water may be increased and an amount of raw water supplied may be adjusted to increase the solubility of the detergent, thereby generating wash water with high concentration.

According to the wash water supplying method according to the present disclosure, a washing effect of reducing remnant detergent may be obtained by supplying the wash water directly into the pump below the tub, without passing through the tub, and an amount of detergent used may be reduced by virtue of reduction of a loss of detergent.

According to the wash water supplying method according to the present disclosure, the detergent with high concentration may be atomized and thus efficiently permeate into the clothes, so as to improve the washing effect.

According to the wash water supplying method according to the present disclosure, the efficient washing effect can be obtained by adjusting the concentration of detergent in the wash water according to an amount of clothes.

MODES FOR CARRYING OUT THE PREFERRED EMBODIMENTS

Embodiments of the present invention will be described below in detail with reference to the accompanying drawings.

Figure 1:
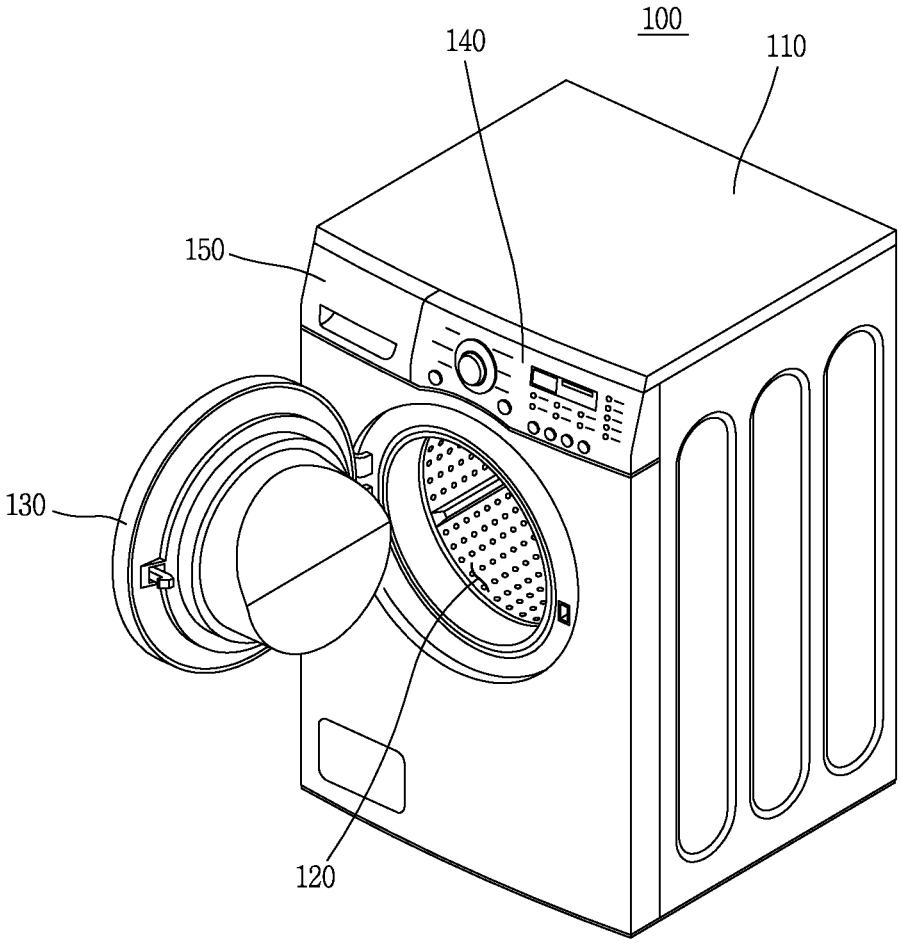
FIG. 1 is a perspective view illustrating an appearance of a washing machine in accordance with one exemplary embodiment of the present disclosure.

FIG. 1 illustrates an appearance of a washing machine in accordance with one exemplary embodiment. A washing machine 100 according to one exemplary embodiment may include a cabinet 110 which defines an appearance of a device. An introduction opening 120 through which clothes as a target to be washed is introduced into the cabinet 110 may be formed through a front surface of the cabinet 110. The introduction opening 120 may be closed and open by a door 130, which is rotatably fixed to the cabinet 100. A manipulation panel 140 with various manipulation buttons for manipulating the washing machine may be located above the cabinet 110. A detergent supply unit 150 in which detergent is contained may be disposed at one side of the manipulation panel 140.

Figure 2:
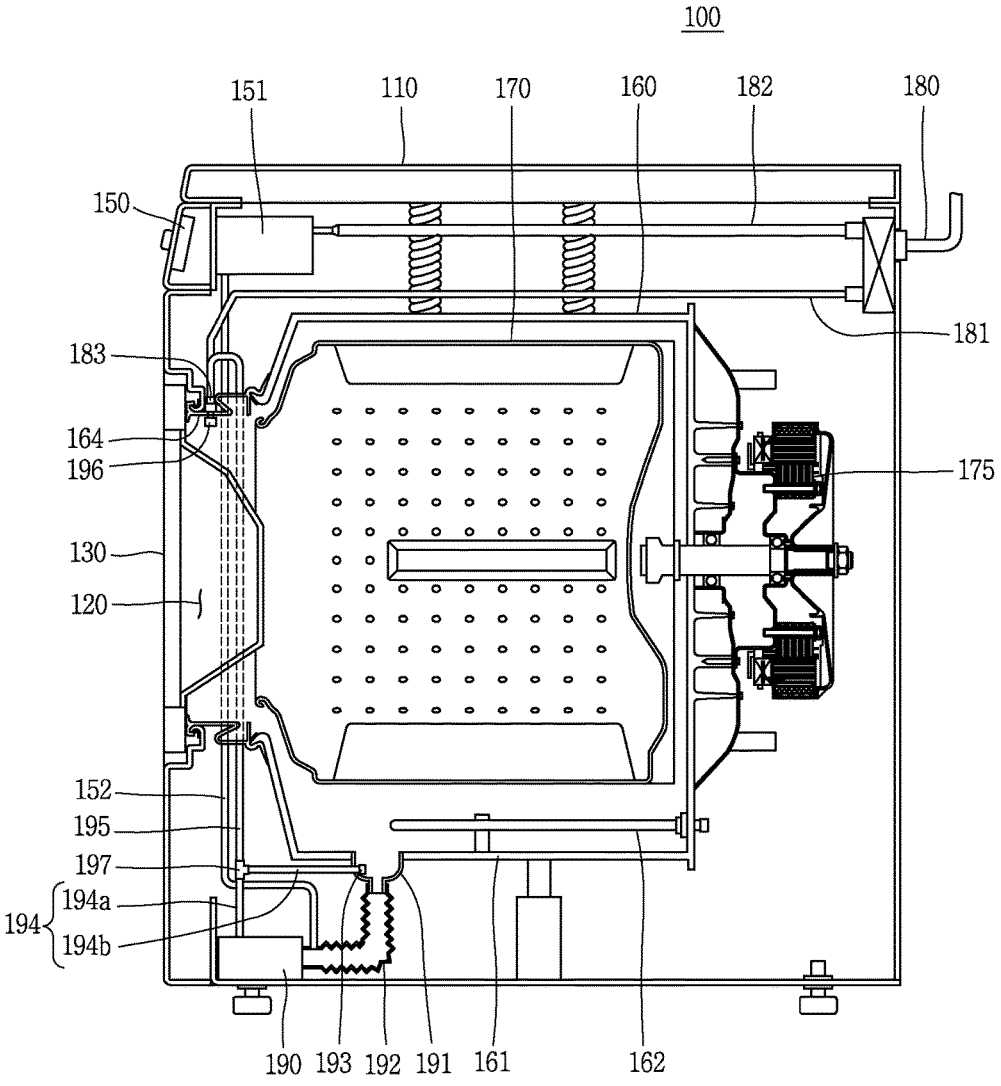
FIG. 2 is a lateral sectional view illustrating an inside of the washing machine of FIG. 1.

FIG. 2 schematically illustrates an internal structure of the washing machine of FIG. 1. As illustrated in FIG. 2, in an accommodation space formed within the cabinet 110 may be disposed a tub 160 formed in a cylindrical shape for storing water or detergent solution, and a drum 170 which is rotatably installed in the tub 160 and in which the clothes as the target to be washed is introduced. A driving unit 175 for driving the drum 170 may be disposed at the rear of the drum 170.

The tub 160 may be formed in the cylindrical shape in which the drum 170 is accommodated. A front surface of the tub 160 may be open to be connected to the introduction opening 120 of the cabinet 110. Hence, a gasket 164 which surrounds peripheries of a front portion of the tub 160 and the introduction opening 120 of the cabinet 110 may be disposed between the front portion of the tub 160 and the introduction opening 120 of the cabinet 110. The gasket 164 may thus prevent wash water contained in the tub 160 from being introduced into the cabinet 110. Also, a first nozzle 196 and a second nozzle 183 which will be explained later may be mounted to the gasket 164.

Figure 3:
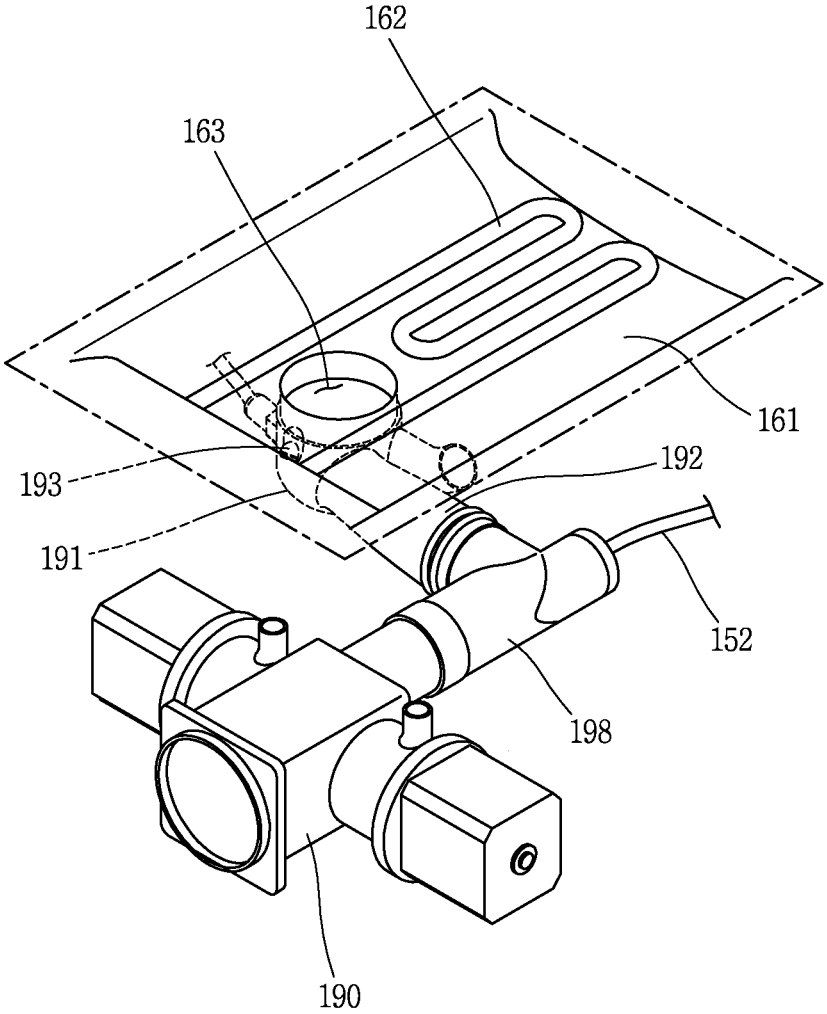
FIG. 3 is a schematic view illustrating draining-related components disposed in a lower part of the washing machine of FIG. 1.

A sump 161 in which wash water contained in the tub 160 is collected to be drained out may be formed on the lower part of the tub 160. FIG. 3 schematically illustrates the sump 161 disposed on the lower part of the tub 160. Referring to FIG. 3, the sump 161 may outwardly protrude from a lower part of the tub 160 so as to form a space for collecting wash water which is to be drained out, and also include a drain 163. For smooth drainage, the sump 161 may have a lower surface which is inclined toward the drain 163. The sump 161 may also be provided with a heater 162 for heating wash water.

The drum 170 may be formed in the cylindrical shape and rotatably installed in the tub 160. Similar to the tub 160, the drum 170 may have a front surface open such that the clothes can be introduced therethrough. The driving unit 175 may be disposed at the rear of the drum 170 to transfer a rotational force to the drum1 170. A plurality of through holes may be formed on a side surface of the drum 170, such that wash water can flow therethrough to be introduced into the tub 160 or be introduced from the tub 160 into the drum 170.

The detergent supply unit 150 may accommodate therein detergent, such as washing detergent, fabric conditioner, bleach or the like, which is to be supplied to the clothes. In more detail, the detergent supply unit 150 may be formed to be drawn out to the front of the cabinet 110 so as to be filled with such detergent. The detergent supply unit 150 may be provided with a detergent box or a detergent storage means 151 in which the detergent is filled. The detergent or the like which is filled in the detergent box or detergent storage means 151 may be mixed with raw water supplied from an external water supply 180, such that the detergent can be contained in wash water. This may be enabled in such a manner that the raw water flowed through a raw water supply passage 182 is supplied to a pump 190, which will be explained later, through a wash water supply passage 152 via the detergent storage means 151. Here, the wash water is water containing the detergent, and thus may be different from the raw water without containing detergent.

Figure 4:
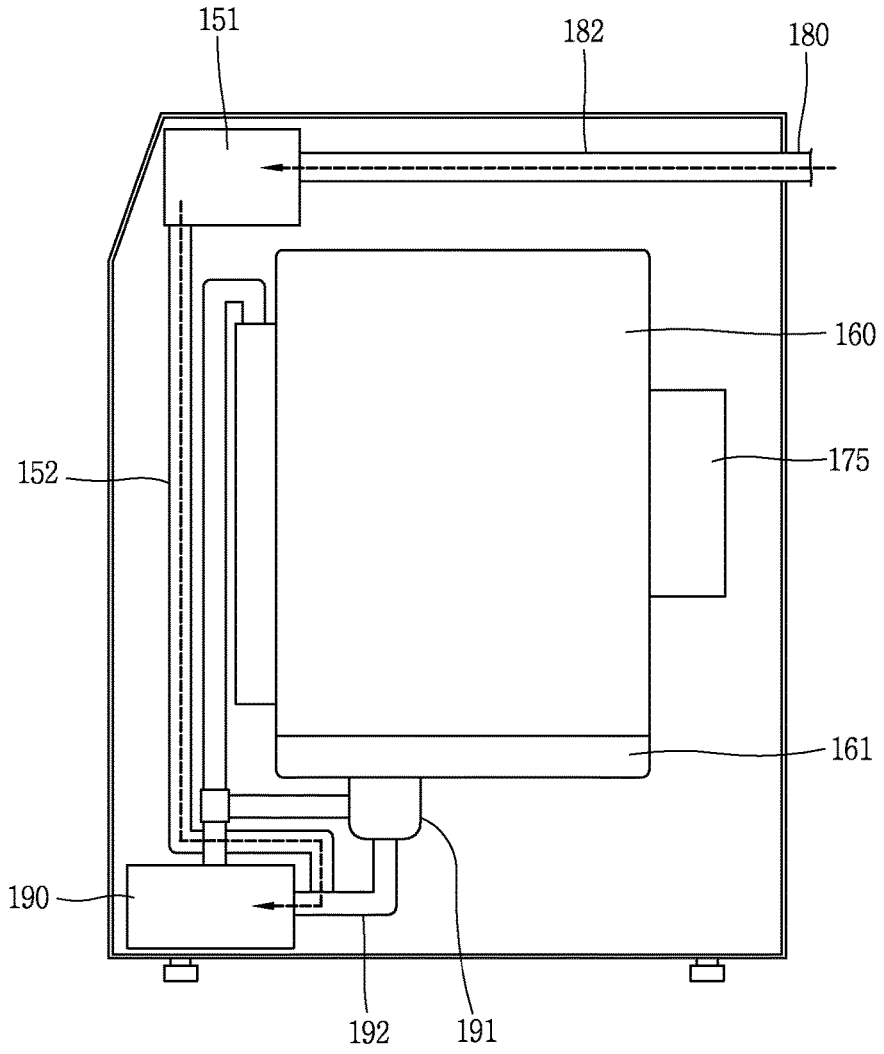
FIG. 4 is a schematic view illustrating a path through which wash water is introduced into a pump.
Figure 5:
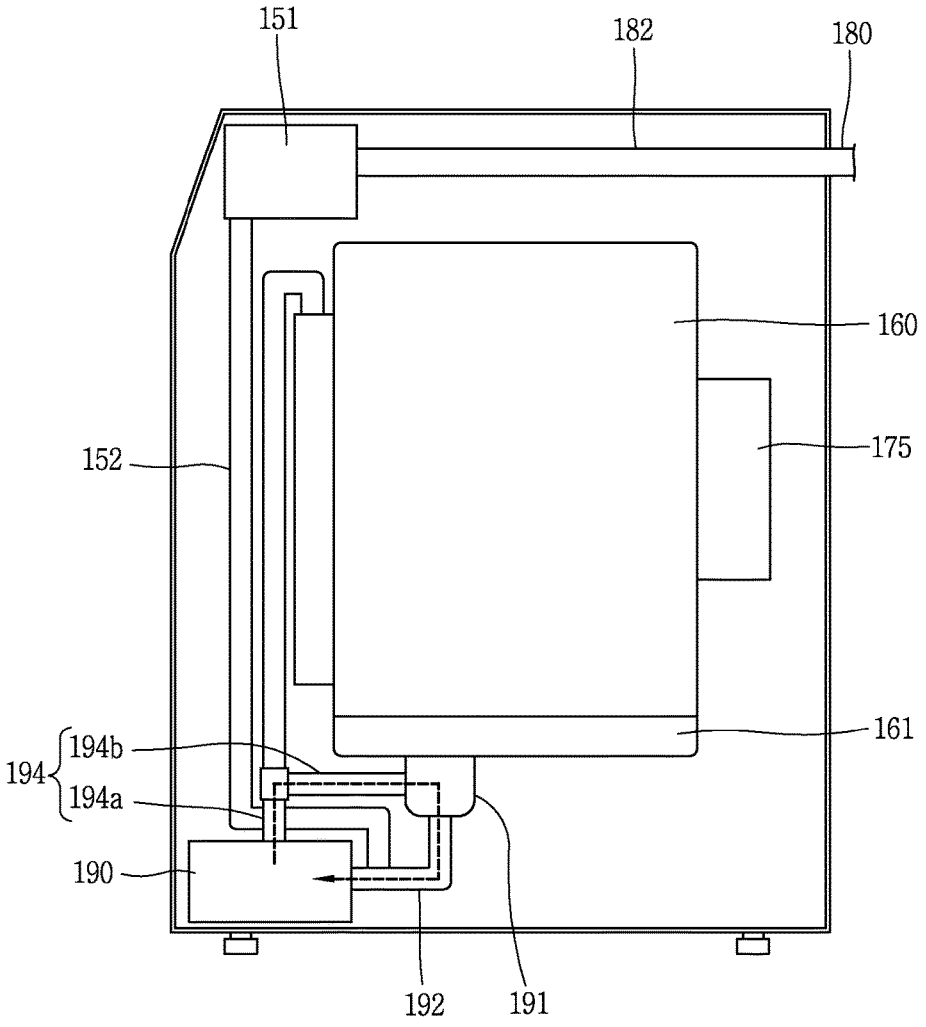
FIG. 5 is a schematic view illustrating a circulation path of wash water between the lower draining-related components of the washing machine.
Figure 6:
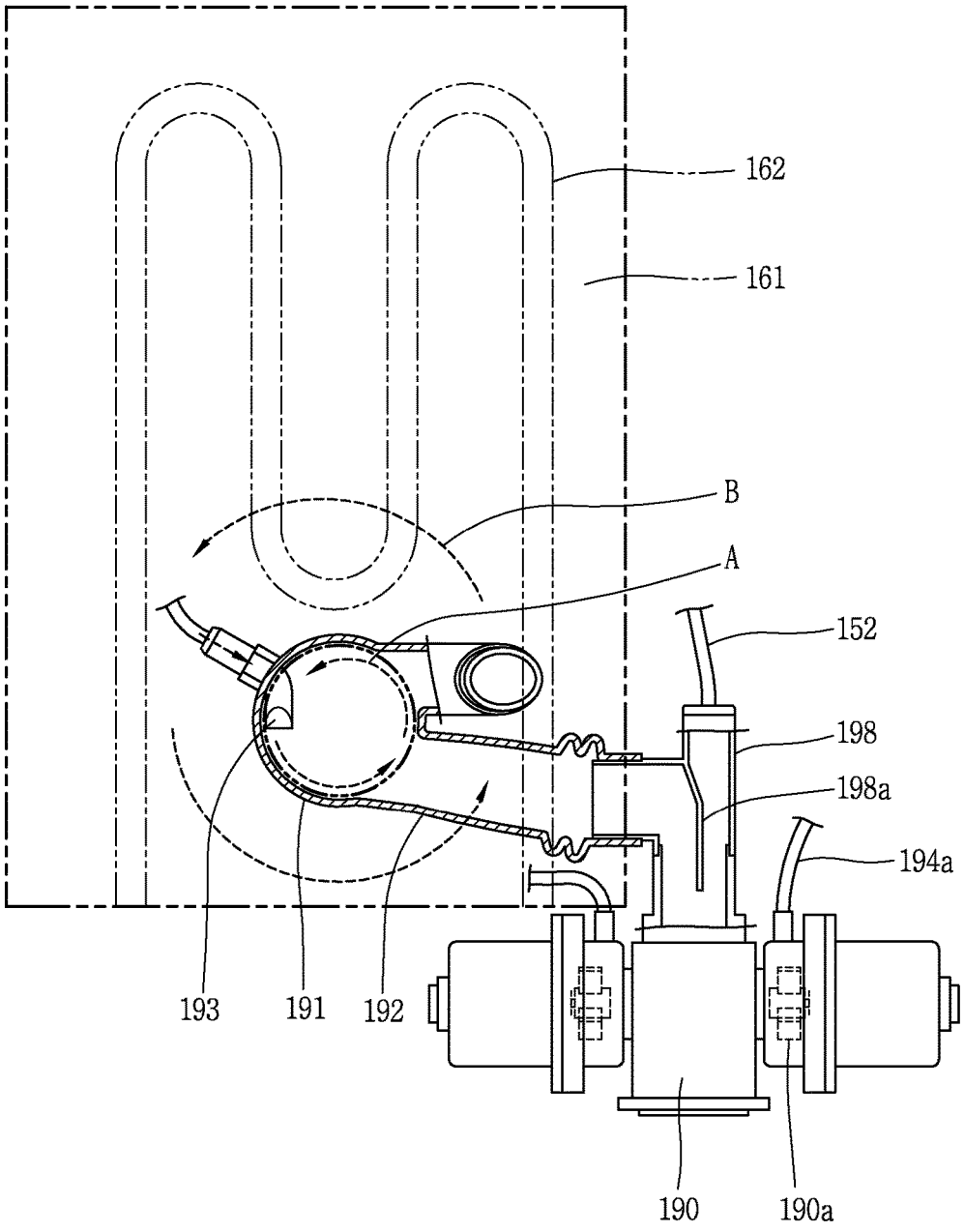
FIG. 6 is a schematic view illustrating a flow of wash water in the pump and a drain chamber.

FIG. 4 illustrates a flow path of wash water supplied to the pump through the detergent supply unit. FIG. 5 illustrates a circulation path of wash water along drainage-related components disposed in the lower portion of the washing machine. FIG. 6 illustrates a schematic flow of wash water in the sump and a drain chamber.

Referring to FIGS. 4 and 6, wash water which has flowed through the detergent supply unit 150 and contains detergent may be collected in the pump 190 below the tub 160 through the wash water supply passage 152, and stirred by an impeller 190*a* of the pump 190. Afterwards, the wash water may then circulate between a lower side of the sump and the pump through a drain-side circulation passage (or flow path) which will be explained later.

A drain chamber 191, which is formed in a semi-circular shape for temporarily accommodating wash water drained or water, may be disposed on the lower part of the drain 163. Wash water flowed through the drain chamber 191 may be introduced into the pump 190 through a water pipe 192 which is formed in a bellows shape.

The wash water introduced in the pump 190 may be discharged to the outside through an external water pipe (not shown) when washing is completed. If the washing is incomplete, the wash water may circulate for resupply into the drain chamber or the drum, so as to be used for the washing operation.

The drain-side circulation passage may be formed by a pipe so as to serve as a path of wash water between the drain chamber 191 and the pump 190. FIG. 5 illustrates the drain-side circulation passage. Referring to FIG. 5, the drain-side circulation passage may include a first passage 194 along which wash water is introduced from the pump 190 into the drain chamber 191, and a second passage 192 along which wash water is introduced from the drain chamber 191 into the pump 190.

The wash water stirred by the impeller 190*a* may be supplied into the drain chamber 191 along the first passage 194 and then return to the pump 190 along the second passage 192, thereby forming one circulation passage.

The drain-side circulation passage may form the circulation passage only by wash water containing detergent, which may allow for generating wash water with high concentration prior to supplying the wash water containing detergent into the drum.

In the meantime, wash water which contains detergent by flowing through the detergent storage means may form a wash water supply passage for supplying wash water into the pump. Referring to FIG. 4, the wash water may be generated as raw water is mixed with detergent while flowing through the detergent storage means 151, and supplied into the pump through the wash water supply passage 152. The wash water supply passage 152 may communicate with the second passage 192.

FIG. 6 illustrates a communicating point 198 between the wash water supply passage 152 and the second passage 192. As illustrated in FIG. 6, the wash water supply passage 152 and the second passage 192 may communicate with each other such that wash water can be supplied into the pump through both of them. Here, a backflow preventing unit 198*a* may be disposed to prevent wash water supplied through the wash water supply passage 152 from flowing back through the second passage 192.

The exemplary embodiment illustrated in FIG. 6 may be characterized in that the backflow preventing unit 198*a* is a partition wall disposed at the communicating point 198 between the second passage 192 and the wash water supply passage 152. However, the present disclosure may not be limited to this. The backflow preventing unit may also be configured as a check valve disposed on the second passage 192 to prevent a backflow of wash water.

The wash water supply passage 152 may supply the raw water supplied from the external water supply directly into the pump 190 via the detergent storage means 151. The raw water supplied from the external water supply may selectively contain detergent upon flowing through the wash water supply passage 152 via the detergent storage means 151. That is, the wash water supply passage 152 may also supply, directly into the pump 190, raw water without containing detergent as well as wash water containing detergent.

The configuration may be designed to remove remnant detergent in such a manner of supplying wash water containing detergent directly into the pump below the tub, without supplying the same through the tub, when the wash water containing the detergent is supplied through the drum or tub, because the detergent frequently remains still on an inner surface of the tub while such wash water flows to the sump along the surface of the tub. This may reduce a loss of detergent supplied in the wash water, resulting in reduction of an amount of detergent used.

Also, the raw water may be supplied from the external water supply directly into the pump without containing detergent so as to adjust the concentration of the detergent, which may allow an amount of wash water required for melting the detergent to be efficiently adjusted.

Figure 7:
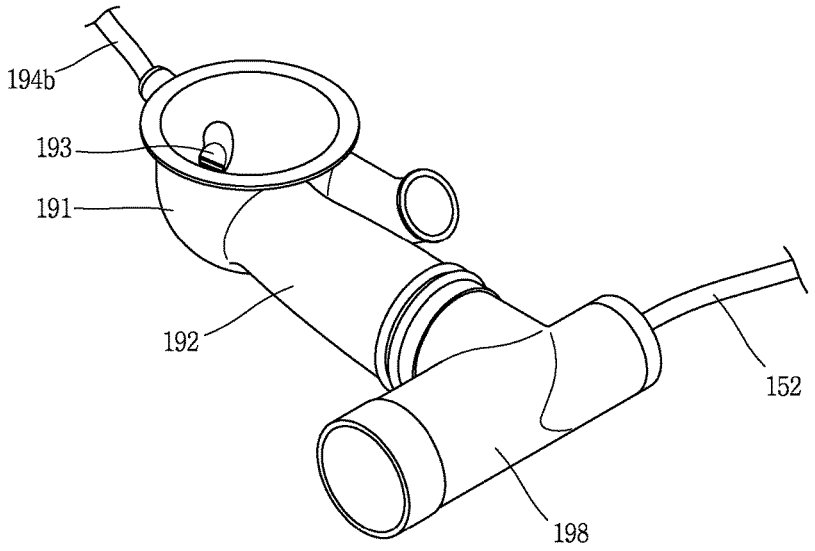
FIGS. 7 and 8 are schematic views illustrating the drain chamber in detail.
Figure 8:
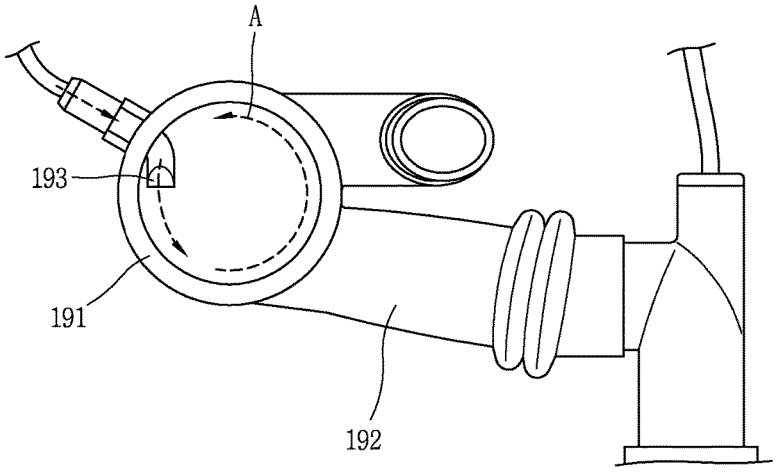

Meanwhile, wash water supplied from the pump 190 may be sprayed into the drain chamber 191. FIGS. 7 and 8 illustrate the drain chamber in more detail. Referring to FIGS. 7 and 8, the drain chamber 191 may be connected to the lower part of the drain 163 formed on a bottom surface of the sump so as to form a space for temporarily storing wash water which is to be drained out.

The drain chamber 191 may have a hemispherical shape as illustrated in FIG. 7, and be provided therein with a spray means 193 for spraying wash water, which has been circulated by the pump 190, into the drain chamber 191. Here, the spray means 193 may be a nozzle.

Wash water which is introduced from the pump into the drain chamber along the first passage 194 may be sprayed into the drain chamber through the nozzle. Here, the nozzle may be provided with a spray opening which is formed in an inner tangent direction of the hemispherical drain chamber. That is, as illustrated in FIG. 8, wash water or water sprayed through the nozzle may be sprayed along the inner tangent direction of the drain chamber and form a stream in a direction indicated with arrows (A). Accordingly, wash water sprayed by the spray means may form an eddy current within the drain chamber.

On the other hand, the drain chamber may be connected to the drain. The sump and the drain chamber always contain some wash water. Accordingly, the eddy current of the wash water formed in the drain chamber may have an influence on the wash water contained in the sump. That is, the wash water sprayed into the drain chamber may form an eddy current in the wash water which is collected in the sump through the drain. This is illustrated in FIG. 6. Referring to FIG. 6, the eddy current of the wash water formed in the drain chamber may be formed as indicated with the arrows (A), and responsive to this, an eddy current may also be formed in the sump 161 as indicated with arrows (B).

Detergent remaining in the sump may not be fully removed merely by the stream formed toward the drain. Especially, the detergent may be filed up in a specific portion of the sump due to a structure such as a heater and the sump's own shape. Hence, when the eddy current is formed within the sump as aforementioned, the detergent which may be filed up in the specific portion of the sump may be efficiently removed by the wash water.

According to the configuration, by reusing the remnant detergent which has been left in the tub, the sump and the drain chamber during a previous washing, an amount of detergent to be supplied may be reduced and the concentration of the detergent may be efficiently increased. Also, the formation of the eddy current in the wash water may result in more effective use of the remnant detergent and improvement of solubility of the detergent.

In addition, the sump 161 may further be provided with a heater 162. As aforementioned, the sump 161 may contain wash water with maintaining a water level to some degree, and the heater 162 may be sunk in the wash water contained in the sump so as to be prevented from being overheated. In this state, when the heater 162 is operating, temperature of the wash water may increase and accordingly the solubility of the detergent may be more improved.

In the meantime, this exemplary embodiment may further include a third passage 195 which is formed by a pipe to serve as a path for supplying wash water from the pump 190 into the drum 170 or the tub 160. This third passage 195 is illustrated in FIG. 9.

Figure 9:
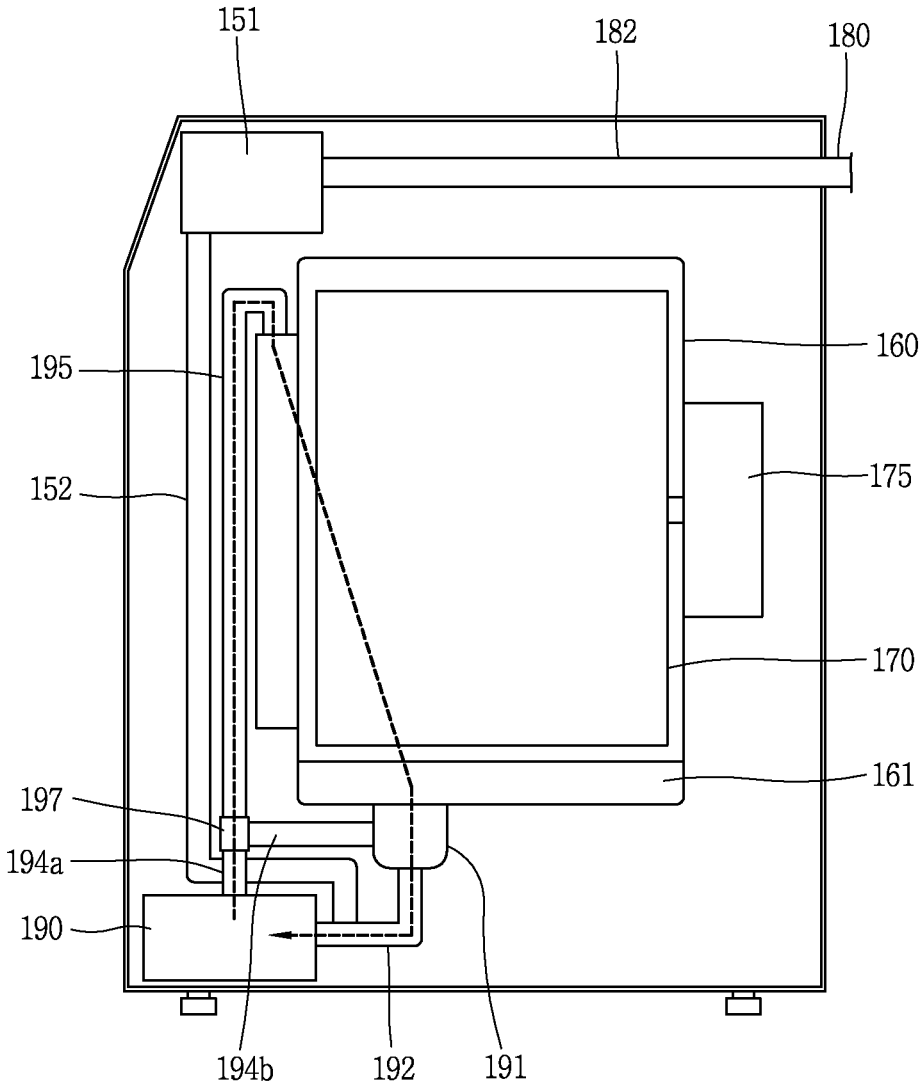
FIG. 9 is a schematic view illustrating a path through which wash water is supplied into the drum and then circulated therein.

Referring to FIG. 9, the third passage 195 may form a wash water supply passage from the pump 190 into the drum 170. Also, the third passage 195 may form a wash water supply passage which passes through the drum and extends into the pump 190 via the sump 161. This may result in formation of a drum-side circulation passage which is different from the drain-side circulation passage.

The third passage 195 may be diverged from the first passage 194. In more detail, the first passage 194 may be divided into a common passage **194*a* of the third passage and a passage 194*b* after the third passage is diverged. Here, a three-way valve 197 which selectively decides a wash water supplying direction may be disposed at a diverged point of the third passage on the common passage 194*a*. Accordingly, the same single pump may be used to efficiently control both the drain-side circulation passage and the drum-side circulation passage. However, the present disclosure may not be limited to this. A separate outlet may be formed on the pump such that wash water can be supplied from the pump 190** into the drum through a path, which is different from the first passage. A separate pump may also be used to supply wash water into the drum.

In the meantime, wash water supplied to the drum may be pressed by the pump 190 to be moved toward the first nozzle 196 through the third passage 195. The wash water may be sprayed into clothes within the drum through the first nozzle 196, recollected in the sump 161 through the through holes of the drum, and then supplied into the pump 190.

Figure 10:
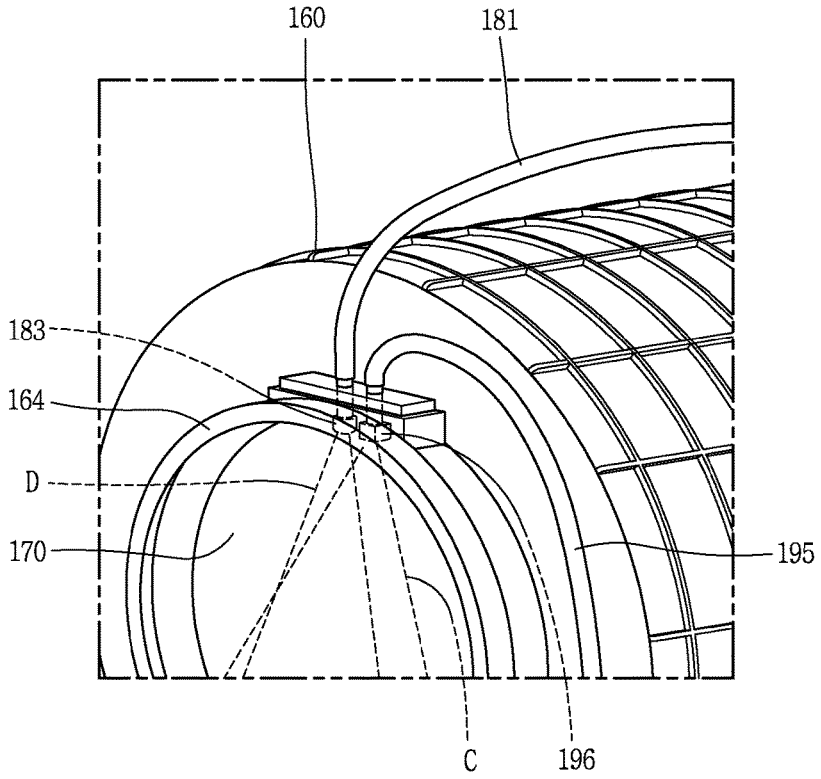
FIG. 10 is a schematic view illustrating installation positions of nozzles and wash water sprayed from the nozzles.
Figure 13A:
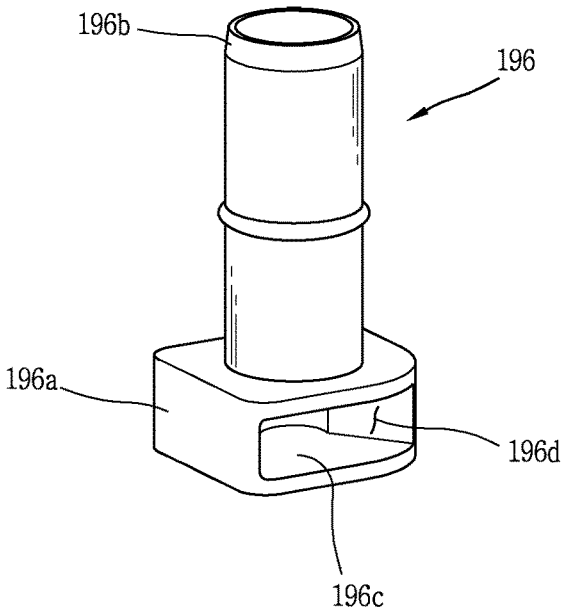
FIG. 13A is a perspective view of the first nozzle.
Figure 13B:
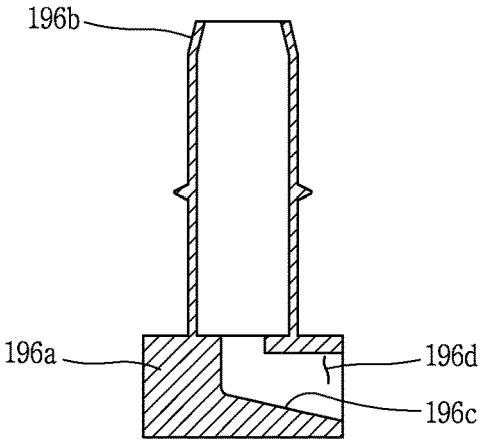
FIG. 13B is a sectional view of the first nozzle.

The first nozzle 196 for spraying wash water into the drum is illustrated in FIG. 13 in more detail. FIG. 10 illustrates an installation position of the first nozzle 196. As illustrated in FIG. 10, the first nozzle 196 may be disposed on an upper portion of the gasket 164 in this exemplary embodiment. That is, when viewed based on the drum, the first nozzle 196 may be located at an upper side of the drum 170 in front of the drum 170. Therefore, the first nozzle 196 may downwardly spray wash water into the drum.

Referring to FIG. 13, the first nozzle 196 may include a nozzle body 196*a*, a nozzle connecting portion 196*b* to be connected to the third passage 195, a nozzle spray opening 196*d*, and a tilt surface 196*c* disposed at the side of the spray opening.

Figure 11:
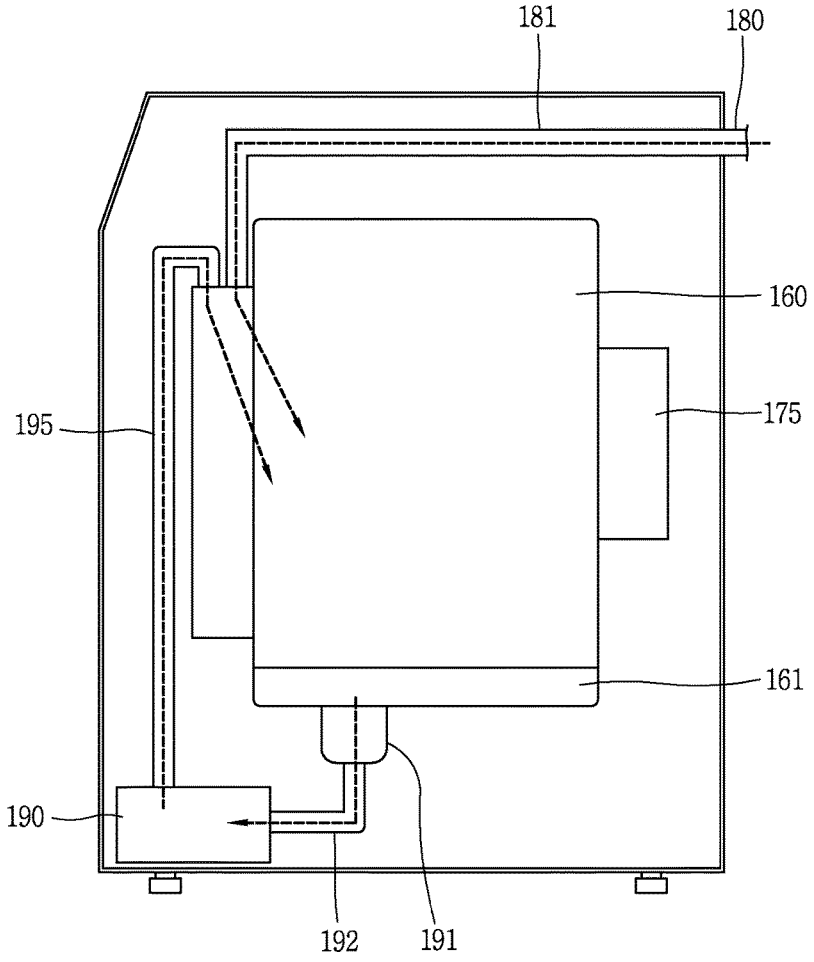
FIG. 11 is a schematic view illustrating a path through which wash water is supplied into the drum through a first nozzle and a path through which external raw water is supplied directly into the drum through a second nozzle.

FIG. 11 schematically illustrates a path along which wash water is supplied from the first nozzle 196 into the tub through the third passage 195. As illustrated in FIG. 11, wash water may be supplied along the third passage 195 as a path through which the wash water flows from the pump 190 into the tub 160. Hence, the nozzle connecting portion 196*b*, which is connected to the third passage 195 in order to guide wash water supplied from the pump 190 to the first nozzle 196, may be disposed on the nozzle body 196*a*.

The first nozzle 196 may spray wash water along a longitudinal direction of the drum. That is, the wash water sprayed from the first nozzle 196 may be sprayed onto an inner surface and a rear surface of the drum along the longitudinal direction of the drum 170.

Figure 15:
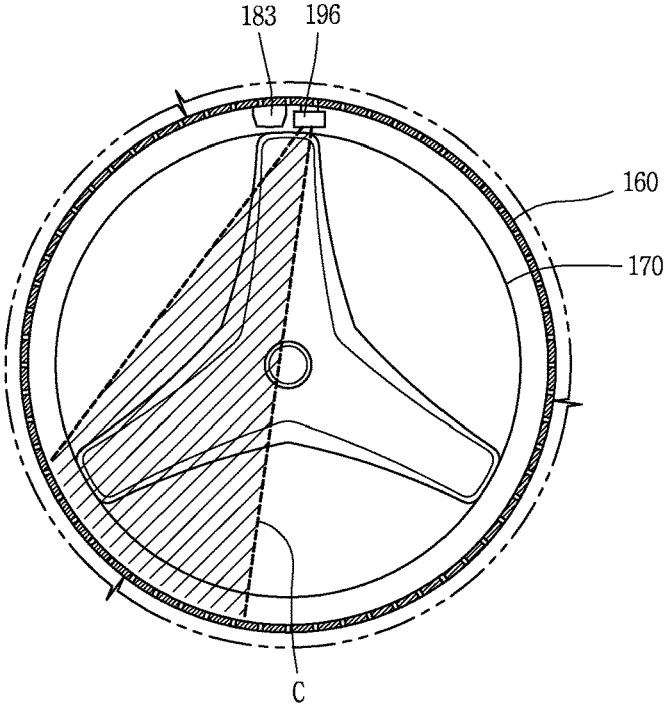
FIG. 15 is a schematic view illustrating a spraying path formed by the first nozzle.

FIG. 15 illustrates a spray path C of wash water which is sprayed from the first nozzle 196 into the drum. While the wash water is sprayed from the first nozzle 196, the drum 170 may rotate. Hence, in order to evenly supply wash water to the clothes accommodated within the drum, the wash water may not have to be sprayed in all directions. Even when the wash water is supplied to parts of the inner surface and the rear surface of the drum along the longitudinal direction of the drum 170, the wash water can be evenly supplied to the clothes in the drum due to the rotation of the drum.

FIG. 15 does not illustrate the spray path in the longitudinal direction because it is a view from the open front surface of the drum. However, the spray path of wash water may form a single flat surface to face the inside of the drum, and an inner portion of the drum which comes in contact with the spray path may be formed such that the wash water can reach the inner surface and the rear surface of the drum in the form of a continuous line. To this end, the tilt surface 196*c* may be formed in the spray opening 196*d* of the first nozzle 196. That is, wash water flowing toward the spray opening 196*d* of the first nozzle 196 may run against the tilt surface 196*c* and be sprayed in a flat form along the tilt surface 196*c*.

The configuration may be designed to efficiently spray wash water to the clothes, namely, to spray the wash water in the longitudinal direction of the drum, taking into account the rotating drum. Accordingly, the wash water sprayed from the first nozzle 196 may be sprayed up to the inner surface and the rear surface of the drum, when viewed from the front (an entrance portion) of the drum, thereby being evenly sprayed onto the clothes.

In the meantime, wash water sprayed from the first nozzle 196 may circulate along the drum-side circulation passage and contain foreign materials and the like. Also, powder-type detergent may form a mass without being completely melted. Accordingly, the spray opening 196*d* of the first nozzle 196 illustrated in FIG. 13 may not have a small cross section, and problems that the nozzle is blocked by foreign materials or detergent and smooth spraying is interrupted may be prevented.

Figure 12A:
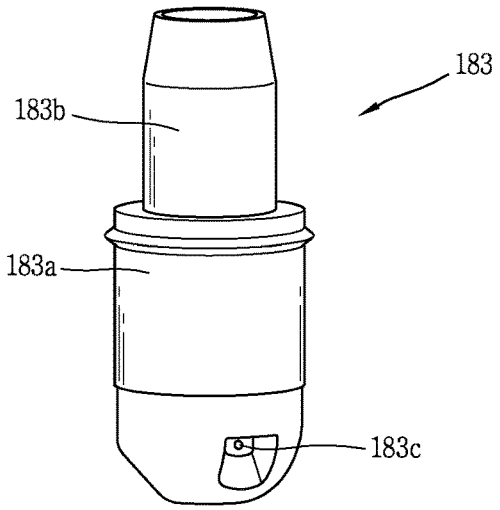
FIG. 12A is a perspective view of the second nozzle.
Figure 12B:
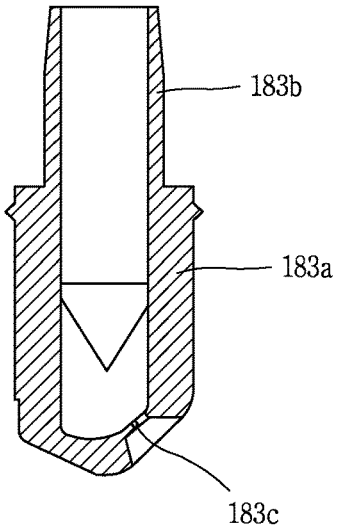
FIG. 12B is a sectional view of the second nozzle.

On the other hand, a second nozzle 183 may be disposed adjacent to the first nozzle 196. FIG. 10 illustrates a position of the second nozzle 183, and FIG. 12 illustrates a more detailed structure of the second nozzle 183. The second nozzle 183 may be configured to directly spray raw water, which is supplied from an external water supply 180, into the drum. This may allow for supply of rinsing water required for washing and adjustment of the concentration of detergent during washing.

FIG. 11 schematically illustrates a path through which external raw water is supplied from the second nozzle 183 directly into the tub 160. As illustrated in FIG. 11, the raw water sprayed from the second nozzle 183 may be supplied from the external water supply 180 to the second nozzle 183 through a direct water passage 181 for supplying raw water. Here, the direct water passage 181 is a passage through which external raw water is supplied directly to the nozzle without passing through the pump or the like, accordingly, it is named as the direct water passage.

According to the configuration, by allowing the raw water to be supplied directly from the external water supply without containing foreign materials, a spray opening 183*c* of the second nozzle 183 may be formed to have a small cross section, which may result in an increase in spray pressure of wash water. Also, since the raw water is supplied directly from the external water supply, water pressure of the external raw water can be used as it is, thereby efficiently obtaining high spray pressure of the raw water.

Referring to FIG. 11, the second nozzle 183 may include a nozzle body 183*a*, a nozzle connecting portion 183*b* and a spray opening 183*c*. The nozzle connecting portion 183*b* may be connected to the direct water passage 181, so as to allow raw water supplied from the external water supply to flow toward the spray opening 183*c*. It may be irrelevant that the spray opening 183*c*, as aforementioned, has the small cross section since raw water without containing foreign materials is sprayed.

Referring to FIG. 10, the second nozzle 183 may be disposed on an upper portion of the gasket 164. That is, when viewed based on the drum 170, the second nozzle 183 may be located at an upper side of the front of the drum. Accordingly, the second nozzle 183 may downwardly spray wash water into the drum.

Raw water sprayed by the second nozzle 183 may be sprayed into the drum in a conical shape. This may be achieved by spraying raw water of high pressure through the narrow spray opening 183*c*. In this case, unlike the aforementioned first nozzle 196, a means for forming a spray path for the raw water may not be separately required, and accordingly, the raw water may be sprayed in the state with high spraying force.

In some cases, the raw water sprayed from the second nozzle 183 may be sprayed in a form of eddy current. This may be sufficiently obtained if a rotation plate for rotating the path of the raw water is disposed before the spray opening 183*c* of the second nozzle 183.

The spray pressure of the raw water sprayed from the second nozzle 183 may be higher than spray pressure of the wash water sprayed from the first nozzle 196. This may be related to the direct water passage 181 connected to the second nozzle 183 and the cross section of the spray opening 183*c* of the second nozzle 183, and configured to atomize the wash water sprayed from the first nozzle 196, which will be explained later.

The second nozzle 183 may be located adjacent to the first nozzle 196. FIG. 10 illustrates that the second nozzle 183 and the first nozzle 196 are disposed on the gasket 164 with being adjacent to each other. Here, the spray opening 196*d* of the first nozzle 196 and the spray opening 183*c* of the second nozzle 183 may be spaced from each other, but the spray opening 196*d* of the first nozzle 196 can face a spray path (D) of the raw water sprayed from the second nozzle 183.

Figure 16:
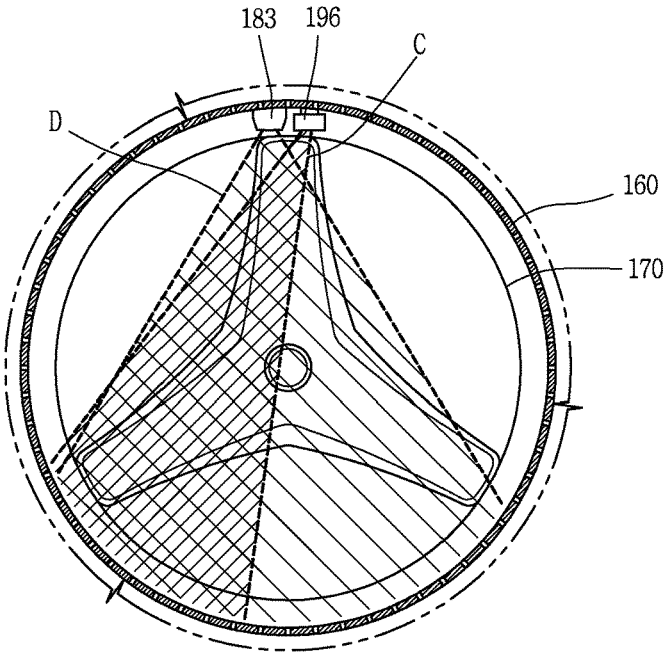
FIG. 16 is a schematic view illustrating that spraying paths formed by the first and second nozzles overlap with each other.

According to the configuration, the spray path of the wash water sprayed from the first nozzle 196 may overlap with the spray path of the raw water sprayed from the second nozzle 183. FIG. 16 schematically illustrates the overlapped spray paths.

Referring to FIG. 16, the spray path (C) of the wash water sprayed from the first nozzle 196 into the drum may overlap with the spray path (D) of the raw water sprayed from the second nozzle 183 into the drum at least one time. As the spray paths overlap with each other, the wash water sprayed from the first nozzle 196 may be atomized due to collision against the raw water sprayed from the second nozzle 183.

That is, the spraying force of the raw water sprayed from the second nozzle 183, which has higher spray pressure than the first nozzle 196, may be higher than that of the wash water sprayed from the first nozzle 196. Therefore, the collision against the raw water with the higher spraying force may result in atomization of the wash water.

According to the configuration, the wash water can be atomized by the collision against the raw water of high water pressure, supplied from the external water supply, without reducing the cross section of the spray opening of the nozzle of the wash water, which contains detergent and foreign materials. Consequently, the atomization of the wash water may be allowed even by such simple structure.

Still referring to FIG. 16, the wash water may collide with the raw water, which is sprayed from the second nozzle 183 in the conical shape, and be partially contained in the raw water from the second nozzle 183 so as to be sprayed into the drum. Therefore, the wash water can be sprayed evenly over a wider range.

Also, the wash water may be affected by higher spraying force due to the collision against the raw water having the high spraying force, accordingly, having high permeability upon contacting the clothes. This may affect a washing performance. When the wash water permeates into the clothes more easily, detergent particles may be stuck to the foreign materials, which are clung to the clothes. It may thusly be much likely for the detergent particles to remove the foreign materials.

Figure 14:
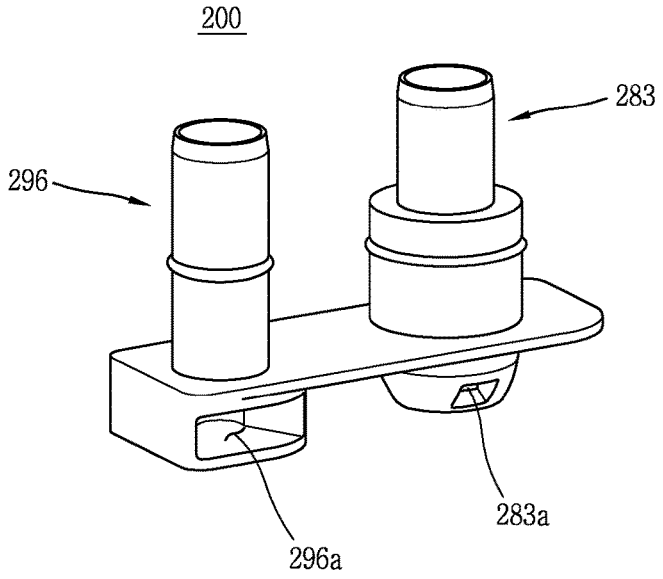
FIG. 14 is a perspective view illustrating another exemplary embodiment of a nozzle according to the present disclosure.

As another exemplary embodiment (200) of the second nozzle and the first nozzle, the second nozzle and the first nozzle may be provided in an integral form. This is illustrated in FIG. 14. Referring to FIG. 14, a nozzle 296 and a second nozzle 283 may be formed integral with each other. Here, a spray opening 296*a* of the first nozzle 296 may face a spray path which is formed by a spray opening 283*a* of the second nozzle 283. This configuration may be more advantageous in productivity, with providing the same effect by the spraying.

Figure 17:
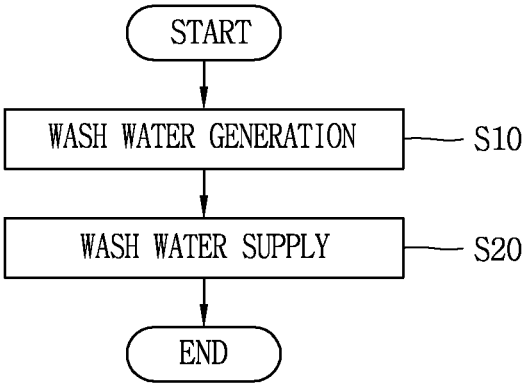
FIG. 17 is a flowchart illustrating a wash water supplying method for a washing machine, in which wash water containing detergent is supplied into a drum, in accordance with one exemplary embodiment of the present disclosure.

In the meantime, FIG. 17 illustrates one exemplary embodiment of a method for supplying wash water containing detergent in a washing machine according to the present disclosure. As illustrated in FIG. 17, a method for supplying wash water in the washing machine according to the one exemplary embodiment, in which wash water containing detergent is supplied into a drum, may include a wash water generating step (S10) and a wash water supplying step (S20). In the wash water generating step (S10), raw water supplied from the external water supply 180 may be supplied into the pump 190 via the detergent storage means 151, and circulate between the pump 190 and the drain chamber 191, thereby generating wash water containing detergent. In the wash water supplying step (S20), the generated wash water may be supplied from the pump 190 into the drum 170.

Referring to FIG. 4, in the wash water generating step (S10), the raw water supplied from the external water supply 180 may be supplied to the pump 190 below the tub 160 through the wash water supply passage 152 via the detergent storage means 151. That is, the raw water may not be supplied into the tub 160 via the detergent storage means 151, but directly supplied into the pump 190 through the wash water supply passage 152 via the detergent storage means 151.

Here, when the raw water supplied from the external water supply 180 is flowing via the detergent storage means 151, the raw water may selectively contain detergent. Accordingly, wash water or raw water which contains the detergent may be selectively supplied through the wash water supply passage 152. Or, in the wash water generating step (S10), the raw water supplied from the external water supply 180 may be supplied into the pump 190 or the drain chamber 191 through the direct water passage 181 via the drum 170, thereby adjusting an amount of wash water which circulates between the pump 190 and the drain chamber 191.

According to the configuration, wash water may be supplied directly into the pump, such that remnant detergent cannot be made. This may allow for reducing a loss of detergent supplied into the wash water and thus reducing an amount of detergent used.

Also, since raw water is able to be supplied from the external water supply directly into the pump so as to adjust the concentration of detergent, an amount of wash water required for melting the detergent may be efficiently adjusted. In addition, since some raw water is required at an appropriate temperature for melting the detergent in the wash water, the wash water can be supplied as necessary as possible.

Afterwards, referring to FIG. 5, in the wash water generating step (S10), the wash water containing the detergent may be generated while the wash water circulates between the pump 190 and the drain chamber 191, namely, between the pump 190 and a lower part of the sump 161 through the drain-side circulation passage. The configurations of the drain chamber 191 and the pump 190 and the flow of the wash water along the drain-side circulation passage have been described with reference to FIGS. 6 to 9.

Specifically, in the wash water generating step (S10), the concentration of detergent in wash water may increase and the detergent remaining in the sump 161 and the drain chamber 191 may be completely melted. In detail, referring to FIG. 6, in the wash water generating step (S10), wash water or raw water may be sprayed into the drain chamber 191 to form an eddy current in wash water, which is collected in the sump through the drain. This may allow the detergent remaining in the drain chamber 191 or the sump 161 to be melted so as to increase the concentration of detergent in wash water.

Also, the detergent remaining in the tub, the sump and the drain chamber may be reused during washing. This may result in reducing an amount of detergent introduced and efficiently increasing the concentration of the detergent. The eddy current may be formed in the wash water so as to allow for an efficient use of the remnant detergent and an increase in solubility of the detergent.

Meanwhile, in the wash water generating step (S10), the heater disposed in the sump may be used to heat wash water. When the heater is operating, the temperature of the wash water may increase and thus the solubility of the detergent may be more improved.

In the wash water generating step (S10), the wash water containing the detergent may be stirred by the impeller 190*a* of the pump 190. That is, raw water or wash water containing detergent, supplied into the pump 190 through the wash water supply passage 152 via the detergent storage means 151, may be stirred by the impeller 190*a*. This may be intended to increase the solubility of the detergent.

In the wash water supplying step (S20), the wash water which has been generated in response to the circulation along the pump 190 and the drain chamber 191 may be supplied into the drum 170.

In the wash water supplying step (S20), referring to FIG. 9, the wash water may be supplied into the tub 160 through the third passage 195. The configuration of the third passage 195 has been described above. That is, the wash water may be supplied from the first passage 194 into the tub 160 via the third passage 195. Here, the three-way valve 197 may also be provided, as aforementioned, so as to determine a supplying direction of the wash water. However, the generated wash water may also be supplied from the pump 190 into the tub 160 through a passage different from the first passage 194 or using a separate motor.

Meanwhile, in the wash water supplying step (S20), the wash water supplied to the tub 160 may be sprayed onto clothes within the drum 170. Referring to FIGS. 10 and 16, the wash water may be sprayed from the first nozzle 196. Simultaneously or separately, raw water supplied from the external water supply may be sprayed from the second nozzle 183 such that its spray path can overlap with the spray path of the wash water at least one time. Here, the wash water may collide with the raw water such that particles of the wash water can be atomized.

With the configuration, particles of the wash water can be more efficiently atomized by the simple structure, improving a washing performance.

Here, spray pressure of the raw water sprayed from the second nozzle 183 may be higher than spray pressure of the first nozzle 196. To this end, referring to FIG. 11, the raw water may be supplied from the external water supply 180 directly to the second nozzle 183 through the separate direct water passage 181.

According to the configuration, wash water can be atomized by the collision against raw water of high water pressure, supplied from the external water supply, without reducing a cross section of the spray opening of the first nozzle 196, from which the wash water containing detergent and foreign materials is sprayed. Specifically, it may be much more effective in case of using wash water containing detergent with high concentration. Also, by the collision against the raw water with the high water pressure, the wash water can be sprayed to the clothes evenly and stereoscopically. By receiving spraying force transferred from the raw water with high spraying force due to the collision, the permeability of wash water into the clothes may increase.

Meanwhile, in the wash water supplying step (S20), the wash water supplied to the tub 160 may be sprayed from the first nozzle 196 to an inner surface and a rear surface of the drum 170 along a longitudinal direction of the drum 170. The wash water may be sprayed while the drum 170 is rotated.

On the other hand, in the wash water supplying step (S20), when wash water is sprayed from the first nozzle 196, raw water may be sprayed from the second nozzle 183 in a conical form or with forming an eddy current, which has been described above in detail. As the raw water is sprayed directly into the drum 170, the wash water can be atomized. Also, the supply of rinsing water required for washing and adjustment of the concentration of detergent during washing can be allowed.

The wash water supplied to the drum 170, on the other hand, may be recollected in the drain chamber 191 through the sump 161 and pressed by the pump 190, referring to FIG. 9, thereby being resupplied to the first nozzle 196. That is, as aforementioned, the wash water may be reused along the drum-side circulation passage so as to have high concentration even by using a less amount of detergent. Also, the wash water can circulate along the drum-side circulation passage, which may allow for economical, eco-friendly washing.

Figure 18:
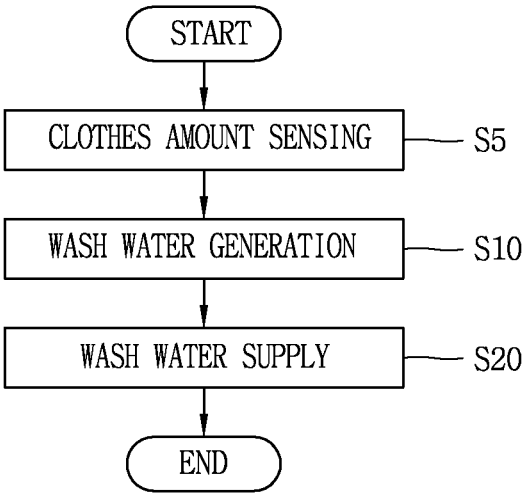
FIG. 18 is a flowchart illustrating a wash water supplying method extending from the exemplary embodiment of FIG. 16.

Referring to FIG. 18, the wash water supplying method according to the present disclosure may further include a clothes amount sensing step (S5). The clothes amount sensing step (S5) may be executed before the wash water generating step (S10) to measure an amount of clothes accommodated in the drum 170. In detail, the clothes amount sensing step (S5) may be executed to sense the amount of clothes accommodated in the drum by use of a sensor disposed in the driving unit 175 of the drum. This technology has generally been well known, so detailed description thereof will be omitted.

In the wash water generating step (S10), the concentration of detergent in the wash water may be adjusted based on the amount of clothes measured in the clothes amount sensing step (S5). Here, in the wash water generating step (S10), as aforementioned, the concentration of detergent in the wash water may be adjusted in such a manner of supplying the raw water from the external water supply 180 directly into the pump 190. Or, the concentration of detergent in the wash water may be adjusted in such a manner of supplying the raw water from the external water supply 180 into the pump 190 via the drum 170.

Consequently, the concentration of detergent may be appropriately adjusted according to the amount of clothes introduced in the drum 170, such that the detergent can efficiently permeate into the clothes.

Although the preferred embodiments of the present disclosure have been illustrated with the accompanying drawings, the claims of the present disclosure should not be construed to be limited to those preferred embodiments and/or drawings but be decided within its scope as defined in the appended claims. All changes and modifications that fall within the metes and bounds of the claims, or equivalents of such metes and bounds are therefore intended to be embraced by the appended claims.

The invention claimed is:

1. A washing machine comprising:

a cabinet;

a tub accommodated in the cabinet, the tub capable of accommodating wash water therein;

a drum rotatably installed in the tub, the drum capable of accommodating the laundry;

a sump disposed on a lower part of the tub and configured to collect the wash water therein;

a drain chamber connected to a lower part of a drain formed on a bottom surface of the sump, the drain chamber temporarily storing the wash water drained out through the drain;

a pump configured to circulate the wash water drained out of the drain chamber;

a drain-side circulation passage forming a path in which the wash water circulates between the drain chamber and the pump;

a first nozzle configured to directly spray the wash water into the drum; and a second nozzle configured to directly spray raw water directly supplied from an external water supply into the drum, wherein a spray opening of the first nozzle faces a spray path of the raw water sprayed from the second nozzle such that the wash water and the raw water collide with each other, and wherein a cross section area of a spray opening of the second nozzle, perpendicular to a direction that the raw water is sprayed into the drum, is smaller than a cross section area of a spray opening of the first nozzle, perpendicular to a direction that the wash water is sprayed into the drum, and a spray pressure of the raw water from the second nozzle is higher than a spray pressure of the wash water from the first nozzle.

2. The washing machine of claim 1, wherein the drain-side circulation passage comprises:

a first passage along which the wash water is introduced from the pump into the drain chamber; and a second passage along which the wash water is introduced from the drain chamber into the pump.

3. The washing machine of claim 2, further comprising a spray head disposed in the drain chamber and configured to spray the wash water flowed through the first passage into the drain chamber, such that the wash water forms an eddy current within the drain chamber.

4. The washing machine of claim 3, wherein the drain chamber is formed in a hemispherical shape, and wherein the spray head comprises a spray opening formed in an inner tangent direction of the drain chamber.

5. The washing machine of claim 2, further comprising:

a detergent storage compartment configured to store detergent therein; and a wash water supply passage along which the wash water flowed through the detergent storage compartment is supplied into the pump, wherein the wash water supply passage communicates with the second passage.

6. The washing machine of claim 5, further comprising a backflow preventing diverter configured to prevent the wash water supplied through the wash water supply passage from flowing back into the second passage.

7. The washing machine of claim 5, wherein the wash water supply passage allows raw water supplied from the external water supply to be supplied into the pump via the detergent storage compartment.

8. The washing machine of claim 2, further comprising a third passage along which the wash water is introduced from the pump into the drum, wherein a drum-side circulation passage is formed by a wash water flow path from the pump to the drum along the third passage and a wash water flow path from the sump into the pump through the drum.

9. The washing machine of claim 1, wherein the drain-side circulation passage comprises:

a first passage along which the wash water is introduced from the pump into the drain chamber; and a second passage along which the wash water is introduced from the drain chamber into the pump, wherein the washing machine further comprises a third passage along which the wash water is introduced from the pump into the tub, and wherein the first nozzle is formed on the third passage.

10. The washing machine of claim 1, wherein the spray opening of the first nozzle and the spray opening of the second nozzle are spaced from each other.

11. The washing machine of claim 1, wherein at least one of the first nozzle and the second nozzle is disposed on an upper side of the drum in front of the drum.

12. The washing machine of claim 1, wherein the first nozzle and the second nozzle are formed integral with each other.

* * * * *